US008052382B2

(12) United States Patent
Konter et al.

(10) Patent No.: US 8,052,382 B2
(45) Date of Patent: Nov. 8, 2011

(54) TURBO MACHINE AND GAS TURBINE

(75) Inventors: Maxim Konter, Klingnau (CH); Alexander Khanin, Moscow (RU); Alexander Burmistrov, Moscow (RU); Sergey Vorontsov, Moscow (RU)

(73) Assignee: ALSTOM Technology Ltd., Baden (CH)

( * ) Notice: Subject to any disclaimer, the term of this patent is extended or adjusted under 35 U.S.C. 154(b) by 88 days.

(21) Appl. No.: 12/487,830

(22) Filed: Jun. 19, 2009

(65) Prior Publication Data

US 2009/0274552 A1 Nov. 5, 2009

Related U.S. Application Data

(63) Continuation of application No. PCT/EP2007/063288, filed on Dec. 4, 2007.

(30) Foreign Application Priority Data

Dec. 19, 2006 (CH) ..... 2058/06

(51) Int. Cl.
*F01D 5/30* (2006.01)
*F01D 11/00* (2006.01)

(52) U.S. Cl. ..... 415/177; 416/193 A

(58) Field of Classification Search ..... 415/177, 415/199.5; 416/193 A
See application file for complete search history.

(56) References Cited

U.S. PATENT DOCUMENTS 3,551,068 A 12/1970 Scalzo et al.
5,293,717 A * 3/1994 Snyder et al. ..... 451/5
(Continued)

FOREIGN PATENT DOCUMENTS

CH 525419 7/1972
(Continued)

OTHER PUBLICATIONS

Search Report for Swiss Patent App. No. 2058/2006 (Jan. 29, 2007).
International Search Report for PCT Patent App. No. PCT/EP2007/063288 (Mar. 12, 2008).

*Primary Examiner* — Edward Look
*Assistant Examiner* — Sean J Younger
(74) *Attorney, Agent, or Firm* — Cermak Nakajima LLP; Adam J. Cermak

(57) ABSTRACT

A gas turbine (1) includes a rotor (2) which has two rotor blade rows (5) with a plurality of rotor blades (6), and also a rotor heat shield (7), which is arranged between them, with a plurality of heat shield elements (12), and with a stator (3) which has a stator blade row (8), with a plurality of stator blades (9), which is arranged axially between the two adjacent rotor blade rows (5). The stator blades (9) have a stator sealing structure (10) radially on the inside. The heat shield elements (12) have a rotor sealing structure (13) radially on the outside which interacts with the stator sealing structure (10) for forming an axial seal (14). Furthermore, a blade radial seal (15) is formed between two adjacent rotor blades (6), and also a heat shield radial seal (16) is formed between two adjacent heat shield elements (12), and in each case separates a gas path (17) from the rotor (2). For increasing efficiency, the heat shield elements (12) and the rotor blades (6) are matched to each other so that the heat shield radial seal (16) merges without interruption into the blade radial seals (15) of the two axially adjacent rotor blades (6) in such a way that a continuous radial seal (21) is formed from the one rotor blade (6), via the heat shield element (12), to the other rotor blade (6).

10 Claims, 1 Drawing Sheet

U.S. PATENT DOCUMENTS 5,758,487 A * 6/1998 Salt et al. ..... 60/806
5,961,286 A * 10/1999 Schaub et al. ..... 415/209.3
6,416,276 B1 * 7/2002 Marmilic et al. ..... 415/178
6,655,153 B2 * 12/2003 Akiyama et al. ..... 60/806
6,857,639 B2 * 2/2005 Beeck et al. ..... 277/637
6,860,110 B2 * 3/2005 Akiyama et al. ..... 60/806
2005/0129525 A1 * 6/2005 Bekrenev et al. ..... 416/248

FOREIGN PATENT DOCUMENTS

DE 19654471 7/1998
EP 1371814 12/2003
WO WO2008/074633 6/2008

* cited by examiner

TURBO MACHINE AND GAS TURBINE

This application is a continuation of, and claims priority under 35 U.S.C. §120 to, International Application no. PCT/EP2007/063288, filed 4 Dec. 2007, and claims priority therethrough under 35 U.S.C. §§119, 365 to Swiss patent application no. 02058/06, filed 19 Dec. 2006, the entireties of which are incorporated by reference herein.

BACKGROUND OF THE INVENTION

1. Field of the Invention

The present invention relates to a rotating turbomachine, especially a gas turbine.

2. Brief Description of the Related Art

Rotating turbomachines customarily have a rotor which has at least two rotor blade rows with a plurality of rotor blades, and also at least one rotor heat shield with a plurality of heat shield elements, wherein the respective rotor heat shield is arranged axially between two adjacent rotor blade rows. In addition, such a turbomachine customarily includes a stator which has at least one stator blade row, which is arranged axially between two adjacent rotor blade rows, with a plurality of stator blades.

For forming an axial seal in the region of the stator blade row, it is possible in principle to equip the stator blades of the stator blade row radially on the inside with a stator sealing structure which is closed in the circumferential direction, and to equip the heat shield elements radially on the outside with a rotor sealing structure which is closed in the circumferential direction and which interacts with the stator sealing structure for forming the axial seal. In addition, it is possible in principle to separate a gas path of the turbomachine, through which the rotor blades and the stator blades extend, from the rotor or from a gas cooling path by radial seals which can be formed between rotor blades which are adjacent in the circumferential direction or between heat shield elements which are adjacent in the circumferential direction.

To increase output or for increasing the efficiency of such a turbomachine, a requirement permanently exists for reducing leakage flows in the region of seals.

SUMMARY

One of numerous aspects of the present invention includes providing a remedy for the aforementioned problems and can be characterized in particular by increased efficiency.

Another aspect is based on the general idea of combining an axial seal, which is formed as a result of the interaction of a stator sealing structure with a rotor sealing structure, with a radial seal which runs from one rotor blade, via the heat shield element, to the other rotor blade. In this way, leakages in the axial direction and also in the radial direction can be reduced, which increases the performance of the turbomachine or its efficiency. The combination of the axial seal in the region of the rotor heat shield with the radial seal which runs in the axial direction via the rotor heat shield, that is to say continuously and without interruption, interacts in this case for efficiency increase. The continuous radial seal, in the case of the turbomachine according to principles of the invention, is realized by the heat shield elements and the rotor blades being matched to each other so that the heat shield radial seal which is formed in the region of the heat shield elements merges without interruption into the blade radial seals which are formed in the region of the rotor blades.

In an advantageous embodiment, the radial seals can be realized by sealing elements which are arranged in the region of the heat shield elements in heat shield slots, and in the region of the rotor blades are arranged in blade slots. By a special matching of the heat shield elements and the rotor blades to each other, the effect can be achieved of axial longitudinal ends of the heat shield slots aligning axially with axially adjacent axial longitudinal ends of the blade slots, as a result of which it is possible to arrange plate-like or strip-like sealing elements so that they extend partially into the heat shield slots and partially into the blade slots of at least one of the adjacent rotor blades. In this way, an axial gap, which is formed axially between the heat shield element and the respective rotor blade, can be effectively covered by the respective sealing element in a region which is located in the circumferential direction between adjacent heat shield elements or in the circumferential direction between adjacent rotor blades, which significantly improves the sealing effect of the radial seal which is formed in this way.

In another advantageous embodiment, the heat shield elements, between their axial ends, can have in each case a radially inwardly receding recess in which the rotor sealing structure is arranged. In this case, a development in which the recess is dimensioned so that the axial seal is formed inside this recess and is arranged in a radially inwardly offset manner relative to the blade radial seals of the adjacent rotor blades, is particularly advantageous. With this type of construction the effect is achieved of the axial seal being located in a region which is located virtually outside a gas flow which flows in the gas path of the turbomachine, which improves the effectiveness of the axial seal. As a result of the recess, inside the gas path an eddy zone is virtually formed, in which the axial seal achieves an improved sealing effect.

Further important features and advantages of the turbomachine according to principles of the invention are evident from the drawing and from the associated FIGURE description with reference to the drawing.

BRIEF DESCRIPTION OF THE DRAWINGS

A preferred exemplary embodiment of the invention is shown in the drawing and is explained in more detail in the following description.

The single FIGURE shows a simplified longitudinal section through a section of a turbomachine.

DETAILED DESCRIPTION OF EXEMPLARY EMBODIMENTS

Figure 1:
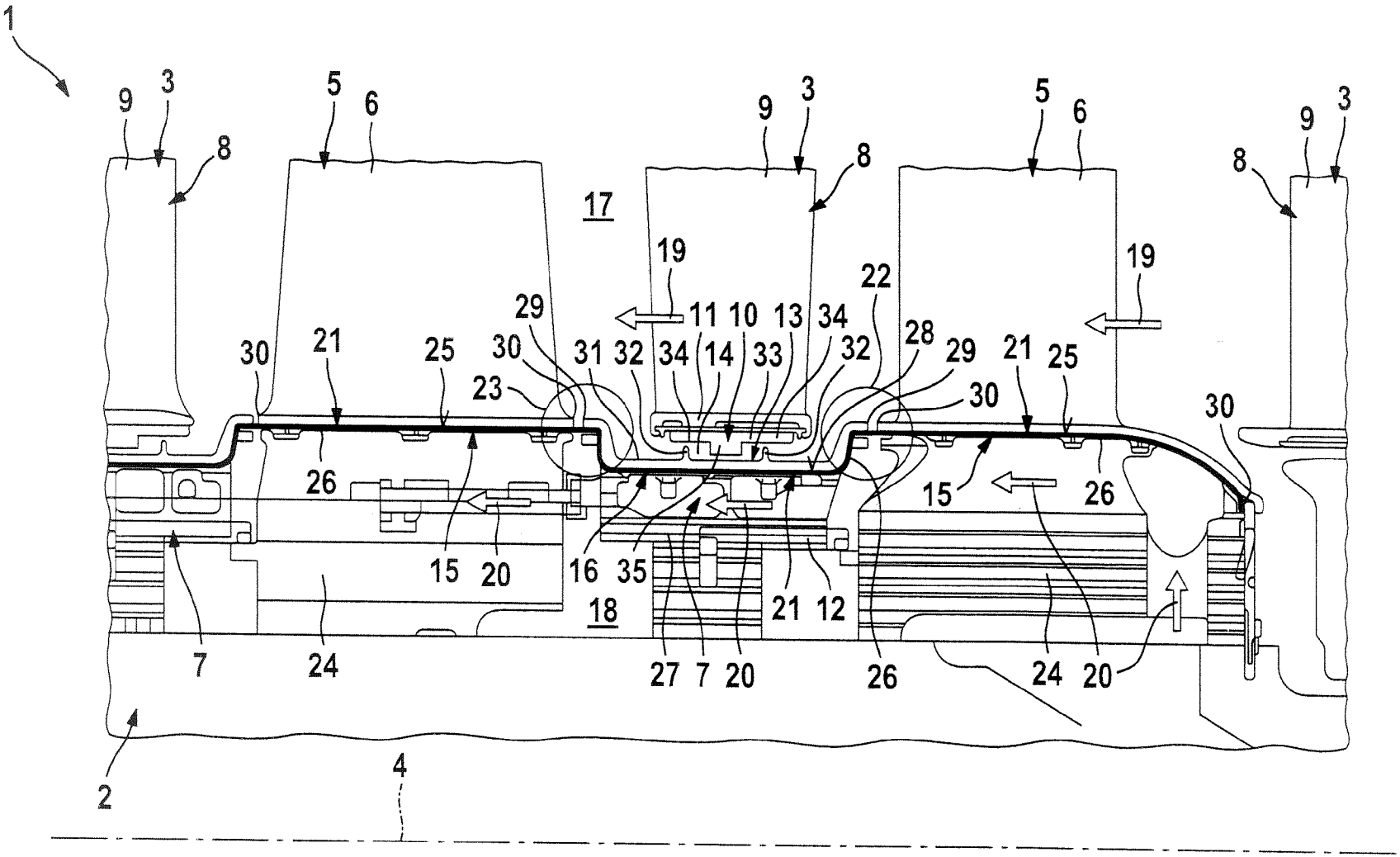

According to FIG. 1, a rotating turbomachine 1, which is only partially shown, includes a rotor 2 and a stator 3. During operation of the turbomachine 1, which is preferably a gas turbine but which can also be a compressor or a steam turbine, the rotor 2 rotates around a rotor axis 4 which at the same time defines the axial direction of the turbomachine 1. The rotor 2 has at least two rotor blade rows 5 which in each case has a plurality of rotor blades 6 which are adjacent to each other in the circumferential direction. Furthermore, the rotor 2 has at least one rotor heat shield 7 which is arranged in each case axially between two adjacent rotor blade rows 5. In the detail of the turbomachine 1 which is illustrated, two rotor heat shields 7 can be seen. The stator 3 can have a plurality of stator blade rows 8, of which at least one is arranged axially between two adjacent rotor blade rows 5. Each stator blade row 8 has a plurality of stator blades 9 which are adjacent in the circumferential direction. If in the following text the stator blade row 8 is mentioned, the at least one stator blade row 8 which is arranged axially between two adjacent rotor blade rows 5 is always meant.

The stator blades 9 of at least one of these stator blade rows 8 have a stator sealing structure 10 radially on the inside, which can be designed in a closed manner in the circumferential direction. For this purpose, for example each stator blade 9, radially on the inside on its blade tip, can have a flat platform 11 which extends in the circumferential direction and also axially, and which can be designed in the manner of a shroud. The stator sealing structure 10 is arranged on these stator blade platforms 11.

The respective rotor heat shield 7 as a rule includes a plurality of heat shield elements 12 which are adjacent in the circumferential direction, which in the manner of annular segments form the respective rotor heat shield 7. The individual heat shield elements 12 have a rotor sealing structure 13 radially on the outside, which extend in a closed manner in the circumferential direction. The rotor sealing structure 13 and the stator sealing structure 10 in this case are radially adjacently arranged and interact for forming an axial seal 14.

The plane of section which is selected in FIG. 1 lies between two rotor blades 6 which are adjacent in the circumferential direction and also between two heat shield elements 12 which are adjacent in the circumferential direction. The plane of section therefore lies in a longitudinal gap which is formed in each case between two rotor blades 6 or heat shield elements 12 which are circumferentially adjacent. In the region of this longitudinal gap, on one side a blade radial seal 15 is formed in each case between two adjacent rotor blades 6 of the same rotor blade row 5, while on the other side a heat shield radial seal 16 is formed in each case between two adjacent heat shield elements 12. Both the respective blade radial seal 15 and the respective heat shield radial seal 16 in the radial direction separate a gas path 17 of the turbomachine 1 from the rotor 2 or from a cooling gas path 18 which is formed radially between the rotor 2 and the respective radial seal 15, 16. During operation of the turbomachine 1, the respective operating gas, for example a hot gas, flows in the gas path 17; a corresponding gas flow is symbolized by arrows 19. The rotor blades 6 and the stator blades 9 extend in each case through the gas path 17. During operation of the turbomachine 1, a cooling gas flow, which is indicated by arrows 20, can flow in the cooling gas path 18.

The heat shield elements 12 and the rotor blades 6 of the rotor blade rows 5 which are adjacent to the rotor heat shield 7 are matched to each other so that the heat shield radial seal 16 merges without interruption both into the blade radial seal 15 which lies upstream and into the blade radial seal 15 which lies downstream. This uninterrupted transition between the heat shield radial seal 16 and the two blade radial seals 15 is realized in this case so that a radial seal 21 can be formed as result, which is designed in a manner in which it runs in the longitudinal direction virtually seamlessly or continuously from the one rotor blade 6, via the respective heat shield element 12, to the other rotor blade 6. It is worth noting in this case that both in the case of a transition 22 which lies upstream and in the case of a transition 23 which lies downstream, a continuous radial seal 21 can be realized between the heat shield element 12 and respective rotor blade 6.

The respective blade radial seal 15, in the region of blade roots 24 of the rotor blades 6 which are circumferentially adjacent, includes in each case a blade slot 25 which is open in the circumferential direction. The two blade slots 25 of the respective blade radial seal 15 lie opposite each other with their open sides in alignment with each other so that a plate-like or strip-like sealing element 26 can be inserted into these blade slots 25. The heat shield radial seal 16 is constructed in a corresponding manner, and in regions 27 which adjoin the rotor sealing structure 13, in the heat shield elements 12 which are adjacent in the circumferential direction, has in each case a heat shield slot 28 which is open in the circumferential direction. Also in this case, the heat shield slots 28 of the two heat shield elements 12, which are adjacent in the circumferential direction, lie opposite each other in alignment with each other in the circumferential direction so that a plate-like or strip-like sealing element 26 can also be inserted into the heat shield slots 28.

The heat shield slots 28 and the blade slots 25 are expediently now matched to each other so that, in the transition regions 22, 23, axial longitudinal ends 29 of the heat shield slots 28 axially align with axially adjacent axial longitudinal ends 30 of the blade slots 25. As a result, it is possible to arrange a common sealing element 26, or a sealing element 26 in each case, in the transition regions 22, 23, so that it extends from the heat shield slots 28 axially into the blade slots 25 or so that it extends from the blade slots 25 of the rotor blades 6 of the one rotor blade row 5 axially into the heat shield slots 28.

In this case, it is possible in principle to use a continuous, relatively long sealing element 26 which extends in the respective slots 25, 28 from the one rotor blade row 5, via the rotor heat shield 7, into the other rotor blade row 5. However, a plurality of sealing elements 26 may preferably be provided, wherein in particular adjacent sealing elements 26 axially abut against each other between the axial longitudinal ends 29 of the heat shield slots 28 and/or between the axial longitudinal ends 30 of the respective blade slots 25. By the same token, it is possible in principle to provide comparatively small sealing elements 26 which are arranged only in the respective transition region 22 or 23 for bridging the annular axial gap there and in this case on one side extend into the heat shield slots 28 and on the other side extend into the blade slots 25.

The heat shield elements 12, according to the exemplary embodiment which is shown here, can have a radially inwardly receding recess 31 between their axial ends, that is to say between the transition regions 22, 23. The rotor sealing structure 13 is arranged in this recess 31. In addition, the stator blades 9 in this case are dimensioned so that the stator sealing structure 10 is also arranged inside this recess 31. According to the preferred embodiment which is shown here, the recess 31 can be dimensioned so that the axial seal 14 which is formed as a result of the interaction of the rotor sealing structure 13 with the stator sealing structure 10 is formed inside the recess 31. The axial seal 14 in this case is arranged in a radially inwardly offset manner relative to the blade radial seals 15 of the adjacent rotor blades 6. As a result of this, the axial seal 14 is located radially outside the gas flow 19 in the gas path 17 and especially in an eddy zone of the gas flow 19.

According to an advantageous embodiment, the stator sealing structure 10 can be designed with grindable allowance. For example, for this purpose the stator sealing structure 10 can be formed as a honeycomb structure 33 with radially oriented honeycombs. The rotor sealing structure 13 is then preferably designed with grinding-in capability. For example, the rotor sealing structure 13 is formed by at least one blade-like annular rib 32. In the example which is shown, two such annular ribs 32 are provided, which are arranged at a distance from each other in the axial direction. During operation of the turbomachine 1, the rotor sealing structure 13 can be ground into the stator sealing structure 10, that is to say the respective annular rib 32 penetrates into the honeycomb structure 33.

The stator sealing structure 10 and the rotor sealing structure 13 expediently interact in the manner of a labyrinth seal for forming the axial seal 14. For this purpose, the stator sealing structure 10 can especially have a plurality, for example two, annular axial sections 34 which are radially outwardly offset in relation to, in this case, a center annular axial section 35 which is adjacent to them. The rotor sealing structure 13 then has a plurality, in this case two, of radially outwardly projecting annular ribs 32 which are arranged in each case in the region of one of the radially outwardly offset radial sections 34.

LIST OF DESIGNATIONS

1 Turbomachine
2 Rotor
3 Stator
4 Rotor axis
5 Rotor blade row
6 Rotor blade
7 Rotor heat shield
8 Stator blade row
9 Stator blade
10 Stator sealing structure
11 Stator blade platform
12 Heat shield element
13 Rotor sealing structure
14 Axial seal
15 Blade radial seal
16 Heat shield radial seal
17 Gas path
18 Cooling gas path
19 Arrow
20 Arrow
21 Radial seal
22 Transition region
23 Transition region
24 Blade root
25 Blade slot
26 Sealing element
27 Region
28 Heat shield slot
29 Longitudinal end of 28
30 Longitudinal end of 25
31 Recess
32 Annular rib
33 Honeycomb structure
34 Axial section
35 Axial section While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A rotating turbomachine comprising:

a rotor which has at least two rotor blade rows with a plurality of rotor blades, and at least one rotor heat shield with a plurality of heat shield elements arranged axially between two adjacent rotor blade rows;

a stator which has at least one stator blade row with a plurality of stator blades arranged axially between two adjacent rotor blade rows;

wherein the stator blades have a stator sealing structure on a radially inside portion thereof which is circumferentially closed;

wherein the heat shield elements each have a rotor sealing structure at a radially outside portion which is circumferentially closed and which interacts with the stator sealing structure to form an axial seal;

a blade radial seal formed between two circumferentially adjacent rotor blades and separating a gas path, through which the rotor blades and the stator blades extend, from the rotor; and a heat shield radial seal positioned between two circumferentially adjacent heat shield elements and separating the gas path from the rotor;

wherein the heat shield elements and the rotor blades are matched to each other so that the heat shield radial seal merges without interruption into the blade radial seals of said two axially adjacent rotor blades to form a continuous radial seal from one of said two axially adjacent rotor blades, via the heat shield element, to the other of said two axially adjacent rotor blades;

wherein the blade radial seal comprises circumferentially open blade slots positioned in the region of circumferentially adjacent blade roots of the rotor blades, and comprising a plate or a strip sealing element in the blade slots;

wherein the heat shield radial seal includes heat shield slots formed in regions of the heat shield elements circumferentially adjacent and which adjoin the rotor sealing structure, the heat shield slots being circumferentially open, and comprising a plate or strip sealing element in said heat shield slots;

wherein axial longitudinal ends of the heat shield slots axially align with axially adjacent axial longitudinal ends of the blade slots;

wherein at least one of said sealing elements extends from the heat shield slots axially into the blade slots of at least one of the adjacent rotor blades, or extends from the blade slots of the rotor blades of the one rotor blade row axially into the heat shield slots; and wherein adjacent sealing elements axially abut against each other between the axial longitudinal ends of the blade slots, or between the axial longitudinal ends of the heat shield slots, or between both.

2. The turbomachine as claimed in claim 1, wherein the heat shield elements comprise, between their axial ends, a radially inwardly receding recess in which the rotor sealing structure is positioned.

3. The turbomachine as claimed in claim 2, wherein the stator blades are dimensioned so that the stator sealing structure is positioned inside the radially inwardly receding recess.

4. The turbomachine as claimed in claim 2, wherein the radially inwardly receding recess is dimensioned so that the axial seal is formed inside the recess and is positioned radially inwardly offset relative to the blade radial seals of adjacent rotor blades.

5. The turbomachine as claimed in claim 1, wherein:

the stator sealing structure comprises a grindable allowance;

the rotor sealing structure comprises a grinding-in portion; and said stator sealing structure grindable allowance and said rotor sealing structure grinding-in portion are both configured and arranged so that, during operation of the turbomachine, the rotor sealing structure grinds into the stator sealing structure.

6. The turbomachine as claimed in claim 5, wherein the stator sealing structure grindable allowance comprises a honeycomb structure with radially oriented honeycombs.

7. The turbomachine as claimed in claim 5, wherein the rotor sealing structure grinding-in portion comprises at least one blade-like annular rib.

8. The turbomachine as claimed in claim 1, wherein the stator sealing structure and the rotor sealing structure together form a labyrinth seal of the axial seal.

9. The turbomachine as claimed in claim 5, wherein:

the stator sealing structure comprises a first annular axial section and a plurality of adjacent second annular axial sections which are radially outwardly offset relative to the first annular axial section; and the rotor sealing structure comprises a plurality of radially outwardly projecting annular ribs each arranged in the region of one of the radially outwardly offset axial sections.

10. The turbomachine as claimed in claim 1, further comprising:

a cooling gas path extending radially between the radial seal and the rotor.

* * * * *